US010099820B2

(12) United States Patent
King et al.

(10) Patent No.: US 10,099,820 B2
(45) Date of Patent: Oct. 16, 2018

(54) DUAL TUBE WITH HERMETIC SEAL

(71) Applicant: KAO USA INC., Cincinnati, OH (US)

(72) Inventors: Christopher King, Monroe, OH (US); Laura Knoll Price, Cincinnati, OH (US); Daisuke Kodama, Tokyo (JP)

(73) Assignee: Kao USA Inc., Cincinnati, OH (US)

( * ) Notice: Subject to any disclaimer, the term of this patent is extended or adjusted under 35 U.S.C. 154(b) by 0 days.

(21) Appl. No.: 15/182,675

(22) Filed: Jun. 15, 2016

(65) Prior Publication Data

US 2016/0368668 A1 Dec. 22, 2016

Related U.S. Application Data

(60) Provisional application No. 62/180,708, filed on Jun. 17, 2015.

(51) Int. Cl.

| | |
|---|---|
| ***B65D 35/22*** | (2006.01) |
| ***B65D 35/38*** | (2006.01) |
| ***B65D 35/44*** | (2006.01) |
| ***B65D 81/32*** | (2006.01) |
| ***B65D 47/36*** | (2006.01) |

(52) U.S. Cl.

CPC ..... *B65D 35/22* (2013.01); *B65D 35/38* (2013.01); *B65D 35/44* (2013.01); *B65D 47/36* (2013.01); *B65D 81/3288* (2013.01)

(58) Field of Classification Search

CPC ..... B65D 35/22; B65D 35/38; B65D 35/44; B65D 47/36; B65D 81/3288; A61C 5/62; A61C 5/64

See application file for complete search history.

(56) References Cited

U.S. PATENT DOCUMENTS

| | | | | | |
|---|---|---|---|---|---|
| 4,566,614 | A * | 1/1986 | Frykendahl | B22D 41/50 | 222/591 |
| 4,964,539 | A * | 10/1990 | Mueller | B65D 35/22 | 215/344 |
| 5,152,432 | A * | 10/1992 | De Laforcade | B65D 47/36 | 222/145.1 |
| 5,290,259 | A * | 3/1994 | Fischer | A61M 5/19 | 222/137 |
| 5,725,499 | A * | 3/1998 | Silverstein | A61M 5/19 | 222/145.1 |
| 5,921,440 | A * | 7/1999 | Maines | B65D 47/265 | 215/6 |
| 6,161,729 | A * | 12/2000 | Gentile | B65D 47/2031 | 222/129 |
| 6,247,617 | B1 * | 6/2001 | Clyde | B65D 1/0238 | 222/541.9 |
| 7,306,130 | B2 * | 12/2007 | Brugner | B05C 17/00503 | 215/254 |

(Continued)

*Primary Examiner* — Frederick C Nicolas
*Assistant Examiner* — Bob Zadeh
(74) *Attorney, Agent, or Firm* — Frost Brown Todd LLC

(57) ABSTRACT

A package for dispensing product includes a tube assembly and an applicator. The tube assembly includes a first tube holding a first product and a second tube holding a second product. A first tube head assembly is coupled with the first tube and includes a first conduit in fluid communication with the first product. A second tube head assembly is coupled with the second tube and includes a second conduit in fluid communication with the second product. The applicator comprises a seal that seals both the first and second conduits.

15 Claims, 6 Drawing Sheets

(56) References Cited

U.S. PATENT DOCUMENTS

| | | | | |
|---|---|---|---|---|
| 8,016,161 | B2 * | 9/2011 | Pierson | A61C 9/0026 222/137 |
| 8,622,245 | B2 * | 1/2014 | Zakrzewski | B65D 35/22 222/153.06 |
| 2008/0041879 | A1 * | 2/2008 | Pierson | A61C 9/0026 222/137 |
| 2011/0186596 | A1 * | 8/2011 | Fontana | B65D 35/22 222/94 |
| 2016/0368668 | A1 * | 12/2016 | King | B65D 35/22 |

* cited by examiner

DUAL TUBE WITH HERMETIC SEAL

PRIORITY

This application claims priority to U.S. Provisional Patent Application Ser. No. 62/180,708, entitled "Dual Tube With Hermetic Seal," filed on Jun. 17, 2015, the disclosure of which is incorporated by reference herein.

BACKGROUND

A product package that is squeezable to dispense product from the package, such as a tube, is known in the art. These packages may be used to dispense a variety of products, including personal care products such as shampoo, conditioner, lotion, soap, hair color, toothpaste, gels, etc. In some instances, it is desirable for a package to include two tubes that allow products to be dispensed from both tubes and mixed together. It may also be desirable for the package to include a single seal that hermetically seals both tubes. As such, there is a need for improved squeezable tube-type product packages that are better sealed.

BRIEF DESCRIPTION OF THE DRAWINGS

While the specification concludes with claims which particularly point out and distinctly claim the invention, it is believed the present invention will be better understood from the following description of certain embodiments taken in conjunction with the accompanying drawings, in which like reference numerals identify the same elements.

Figure 1:
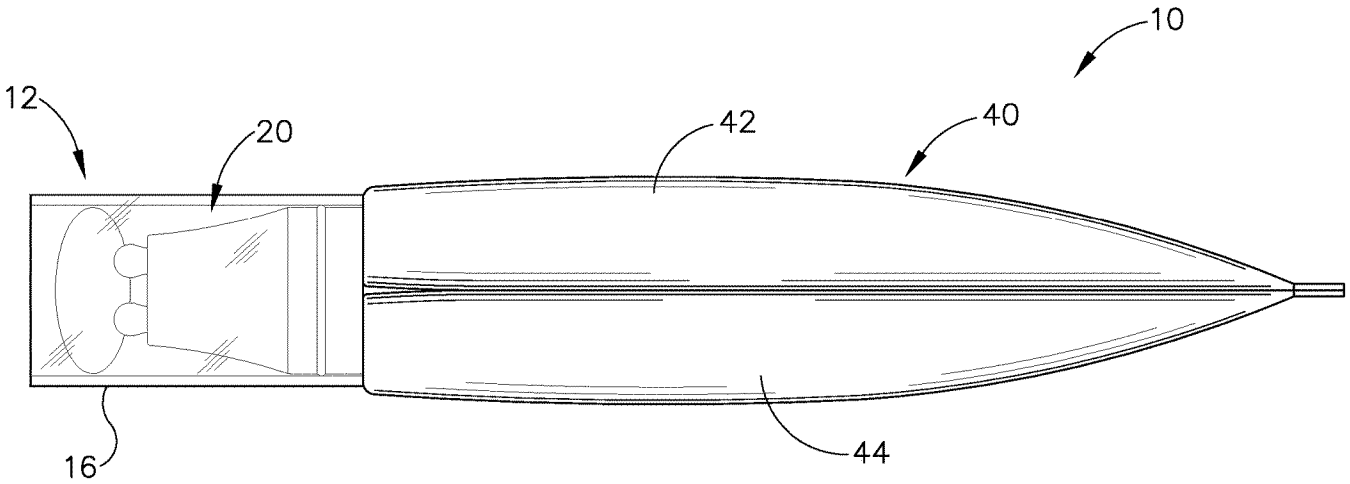
FIG. 1 depicts a side view of a product package.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain embodiments of the present disclosure should not be used to limit the scope of the present disclosure. Other examples, features, aspects, embodiments, and advantages of the invention will become apparent to those skilled in the art from the following description. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

In some instances, personal care products are stored in separate tubes such that the products can be dispensed and mixed together, for example, if there is a stability issue when two components of a product are mixed together. It may be desirable to provide a product package having separated tubes that allow the product in each tube to be dispensed simultaneously for mixing. Each tube of the product package can be hermetically sealed to prevent air and/or water from entering the package or to prevent the products from being accidentally dispensed from the package. Because the product package includes more than one tube, a seal for each tube may be inadequate. Accordingly, a single seal can be used to hermetically seal all tubes or multiple tubes of the product package. This may decrease the amount of time it takes to open the package by providing a single seal that is easily removable. This may also decrease the costs of the package by using less material for a single seal.

Figure 2:
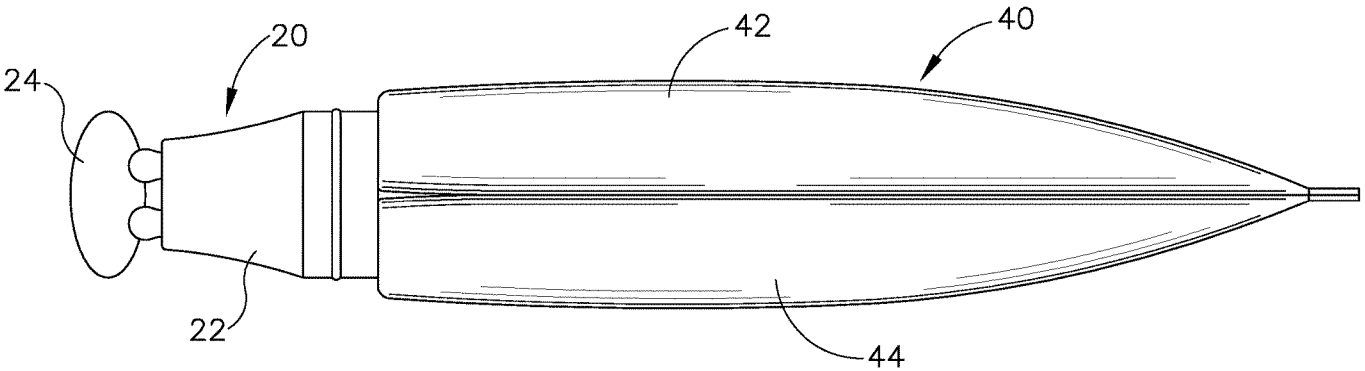
FIG. 2 depicts a side of view of the product package of FIG. 1 with a cap removed.

FIG. 1 shows an embodiment of a product package (10) having a tube assembly (40), an applicator (20), and a cap (12). Tube assembly (40) includes a first tube (42) and a second tube (44), but any other suitable number of tubes may be used. As best seen in FIG. 2, applicator (20) is coupled with tube assembly (40). Applicator (20) comprises a seal (24) that is configured to hermetically seal both tubes (42, 44) of tube assembly (40). Cap (12) is then positioned over applicator (20). In the illustrated embodiment, cap (12) comprises a cylindrical shape having a substantially flat end (16) such that package (10) can stand in an upright position on cap (12). Cap (12) may also be configured to protect applicator (20) during transportation and storage of package (10). Still other suitable configurations for cap (12) will be apparent to one with ordinary skill in the art in view of the teachings herein.

Figure 3:
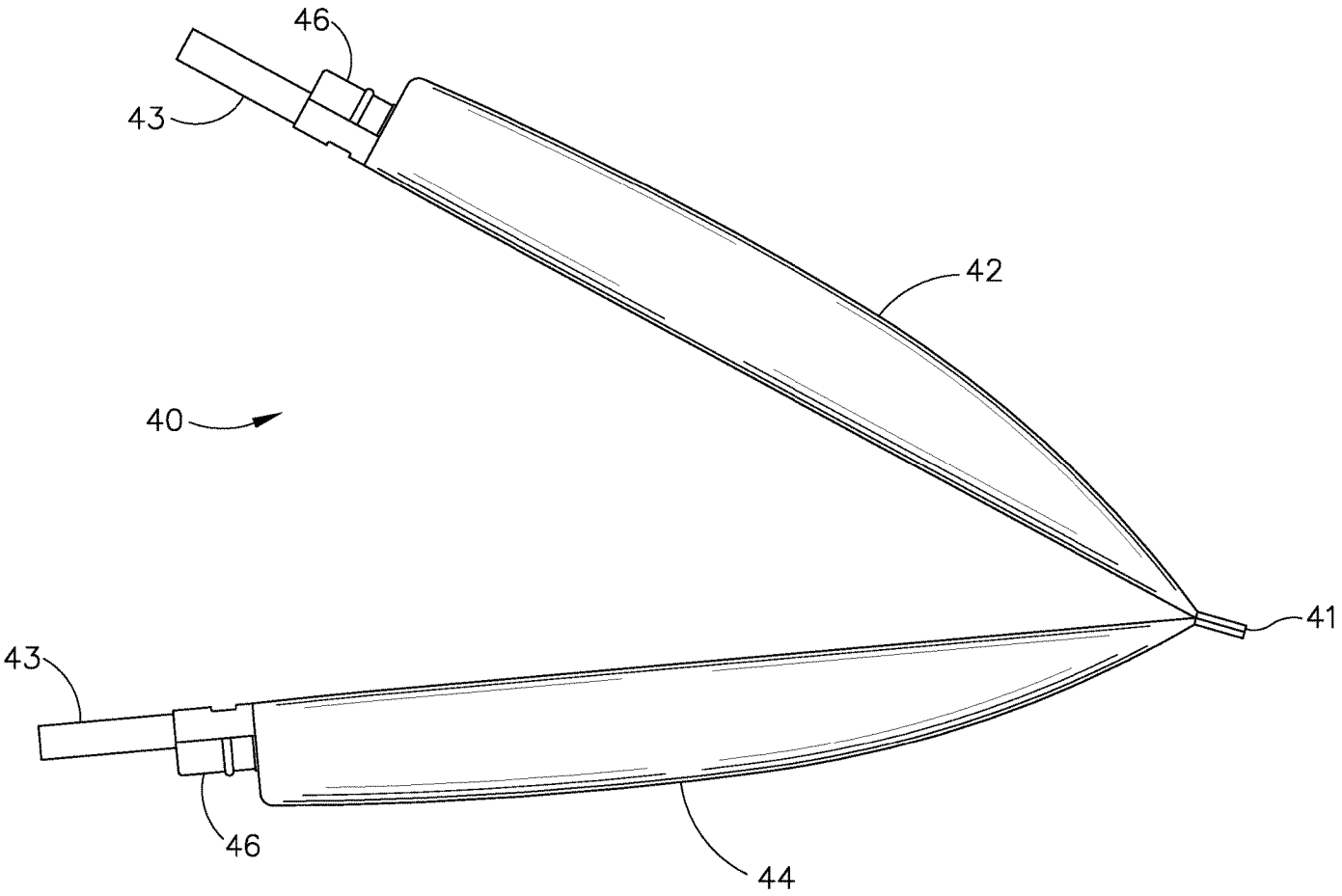
FIG. 3 depicts a side view of a tube assembly of the product package of FIG. 1.
Figure 4:
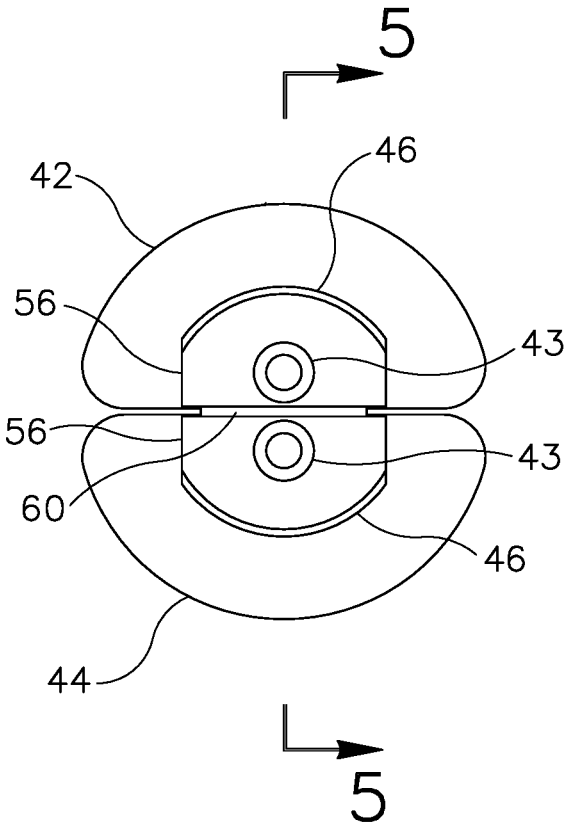
FIG. 4 depicts a top view of the tube assembly of FIG. 3.

FIGS. 3-6 show tube assembly (40) in greater detail. As best seen in FIG. 3, tube assembly (40) comprises separate tubes (42, 44) that are flexible such that each tube (42, 44) may be squeezed to dispense product from package (10). The material of tubes (42, 44) is selected to be compatible with the product stored within tubes (42, 44). For instance, tubes (42, 44) may be made from high-density polyethylene, low-density polyethylene, polypropylene resin, or any other suitable flexible material. In the present embodiment, the walls of tubes (42, 44) are between about 0.2 mm and about 0.7 mm thick, but any other suitable wall thickness can be used. Each tube (42, 44) can be injection molded, extruded, or laminated as a sleeve. Tubes (42, 44) may be secured together at end (41) by crimping, adhesive, welding, fasteners, etc. Each tube (42, 44) is thereby closed at end (41). Tubes (42, 44) may be closed when tubes (42, 44) are secured together or tubes (42, 44) may be closed prior to being secured together. In the present embodiment, end (41) is flexible such that tubes (42, 44) can pivot relative to each other about end (41) when applicator (20) is removed. Each tube (42, 44) further comprises a substantially semi-circular profile with a flattened surface facing the opposing tube (42, 44). Accordingly, when tubes (42, 44) are positioned adjacent to each other, tubes (42, 44) form a substantially circular profile, as shown in FIG. 4. For instance, each tube (42, 44) can have a thickness t of between about 12 mm and about 13 mm at the arc of the tube (42, 44) (FIG. 5) and a width w of between about 23.1 mm and about 24.1 mm (FIG. 6), but other dimensions and configurations for tubes (42, 44) can be used.

Figure 5:
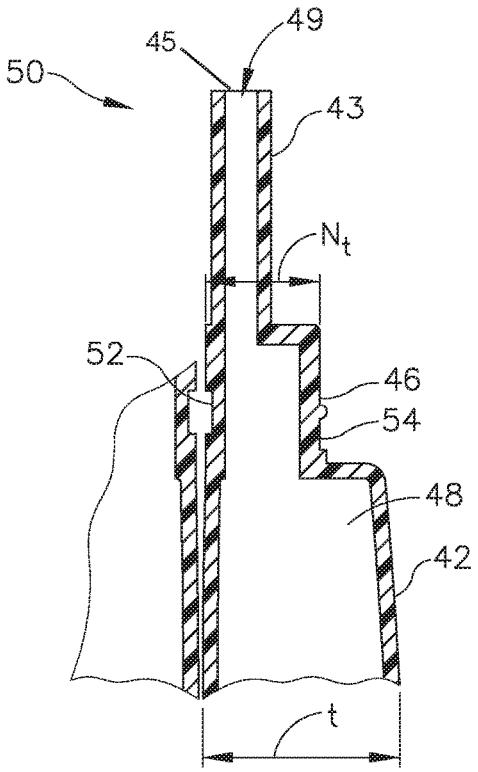
FIG. 5 depicts a cross-sectional side view of a tube of the tube assembly of FIG. 4, taken along line 5-5 in FIG. 4.
Figure 6:
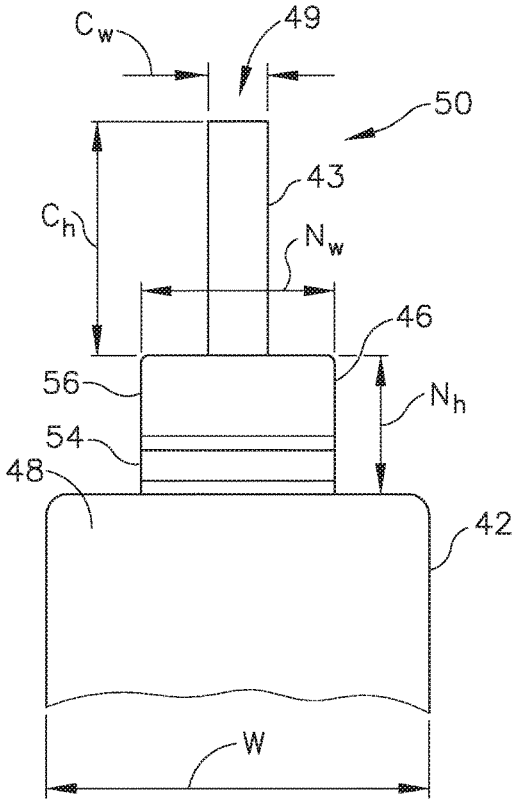
FIG. 6 depicts a cross-sectional front view of the tube of FIG. 5.

Tube assembly (40) further comprises a tube head assembly (50) at the dispensing end of each tube (42, 44). While FIGS. 5 and 6 show tube head assembly (50) coupled to first tube (42), tube head assembly is also coupled to second tube (44) in the opposing direction (FIG. 4). Tube head assembly (50) comprises a neck (46) and a conduit (43) extending outwardly from neck (46). An opening (49) extends through neck (46) and conduit (43) that is in fluid communication with hollow area (48) in tube (42). Accordingly, product stored in hollow area (48) of tube (42) can be dispensed through opening (49) when tube (42) is squeezed. Tube head assembly (50) can be injection molded directly onto the tube (42, 44), tube head assembly (50) can be injection molded as a single piece with tubes (42, 44), or tube head assembly (50) can be injection molded separately and later attached to each tube (42, 44). Tube head assembly (50) is sufficiently rigid to allow product to be dispensed from tubes (42, 44). Tube head assembly (50) may be made from high-density polyethylene, low-density polyethylene, polypropylene resin, or any other suitable material. Other suitable manufacturing configurations for tube head assembly (50) will be apparent to one with ordinary skill in the art in view of the teachings herein.

Conduits (43) are shown as being cylindrical, but any other suitable shape may be used (e.g., square, triangular, rectangular, hexagonal, octagonal, etc.). In the present embodiment, each conduit (43) has a height $C_h$ of about 16 mm (FIG. 6), and a width $C_w$ of about 3.175 mm (FIG. 6), but any other suitable dimensions may be used. A throttling orifice (45) is used at the end of conduit (43) at opening (49) to equalize flow between products with various viscosities that may be stored in each tube (42, 44). This allows for easy adjustment of the orifice diameter during manufacturing and prevents the need to adjust the design of applicator (20).

Neck (46) comprises a substantially semi-circular profile that corresponds to tube (42) such that each neck (46) creates a substantially circular profile when necks (46) are positioned adjacent to each other (FIG. 4). Further, neck (46) comprises a substantially flat face (56) on each side of neck (46) that aligns with flat faces (56) on the opposing neck (56) when tubes (42, 44) are viewed side by side. In the present embodiment, each neck (46) has a height $N_h$ of about 8.8 mm (FIG. 6), a thickness $N_t$ of about 14 mm (FIG. 5), and a width $N_w$ of about 8 mm (FIG. 6), but other suitable dimensions may be used.

The circular portion of neck (46) comprises a recess (54) that can receive a corresponding flange on applicator (20). Accordingly, applicator (20) can be snap fit onto each neck (46) to removably couple applicator (20) with tube assembly (40). Other suitable configurations to couple applicator (20) with tube assembly (40) will be apparent to one with ordinary skill in the art in view of the teachings herein. For instance, applicator (20) may be coupled with tube assembly (40) via threading, a friction fit, etc.

Figure 7:
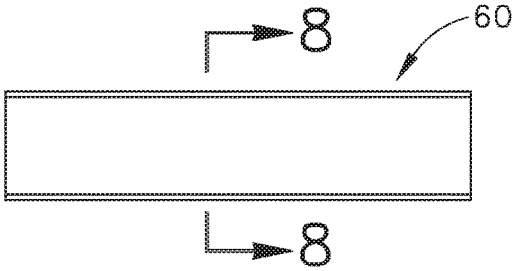
FIG. 7 depicts a front view of a connector for use with the tube assembly of FIG. 3.
Figure 8:
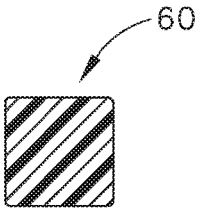
FIG. 8 depicts a cross-sectional side view of the connector of FIG. 7 taken along the line 8-8 of FIG. 7.

The opposing side of neck (46) comprises a slot (52). Slot (52) is configured to receive connector (60) shown in FIGS. 7 and 8. Connector (60) comprises a substantially square profile that extends along a length of neck (46). Accordingly, a portion of connector (60) is configured to slide into slot (52) of each neck (46) of tube head assembly (50). Connector (60) is thereby removably coupled with necks (46) to selectively maintain the position of each neck (46) relative to the other neck (46). For instance, connector (60) maintains the space between each neck (46) to provide a separation force between the tube head assembly (50) and the applicator (20) to make removing the applicator (20) from the tube head assembly (40) more difficult. The selective coupling of necks (46) may be desirable to allow tubes (42, 44) to more easily be filled with a product and assembled with tube head assembly (50) when tubes (42, 44) are positioned apart. Necks (46) can then be coupled together by the applicator (20) to attach the top ends of tubes (42, 44) together to allow for easier dispensing of the products from tubes (42, 44). Other suitable configurations for maintaining the positions of tubes (42, 44) will be apparent to one with ordinary skill in the art in view of the teachings herein. For instance, necks (46) of tubes (42, 44) can be adhered, welded, or otherwise secured together at any portion of tubes (42, 44) or tube head assembly (50).

Figure 10:
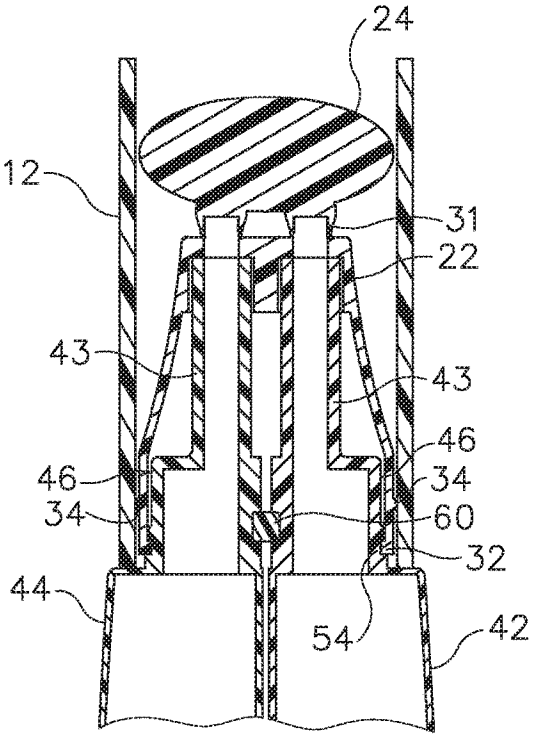
FIG. 10 depicts a cross-sectional side view of the applicator coupled with the tube assembly of the product package of FIG. 1.
Figure 9:
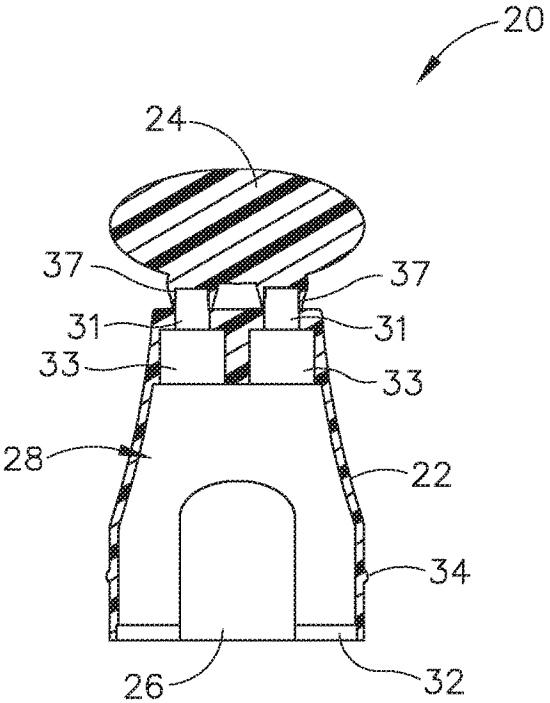
FIG. 9 depicts a cross-sectional side view of an applicator of the product package of FIG. 1.

Referring now to FIG. 9, an applicator (20) is shown that is configured to dispense products from tube assembly (40). Applicator (20) comprises a dispenser (22) and a seal (24). Dispenser (22) comprises a conical shape having an opening (28) within and a pair of recesses (33) extending from opening (28). Accordingly, opening (28) is configured to receive both necks (46) of tube head assembly (50) and each recess (33) is configured to receive a conduit (43) of tube head assembly (50) (FIG. 10). While two recesses (33) are shown, dispenser (22) can comprise any other suitable number of recesses (33) that correspond to the amount of conduits (43) used with tube assembly (40). Dispenser (22) further comprises an annular flange (32) that corresponds to recess (54) of tube head assembly (50) such that annular flange (32) is configured to snap fit within recess (54) to selectively couple applicator (20) with tube head assembly (50). Still other suitable methods to couple applicator (20) with tube head assembly (50) will be apparent to one with ordinary skill in the art in view of the teachings herein. For instance, applicator (20) can be coupled with tube head assembly (50) via threading, friction fit, etc.

Dispenser (22) further comprises a protrusion (26) extending inwardly into opening (28) that corresponds to flat face (56) of necks (46). Accordingly, each flat face (56) of necks (46) abuts protrusion (26) to thereby prevent applicator (20) from rotating relative to tube head assembly (50). Other suitable methods for preventing rotation of applicator (20) relative to tube head assembly (50) will be apparent to one with ordinary skill in the art in view of the teachings herein. An annular flange (34) is also provided on an outer surface of dispenser (22) that is configured to engage cap (12), as shown in FIG. 10. This may maintain the position on cap (12) on applicator (20). Still other suitable methods to couple applicator (20) with cap (12) will be apparent to one with ordinary skill in the art in view of the teachings herein. For instance, applicator (20) can be coupled with cap (12) via threading, snap fit, etc.

As shown in FIGS. 9 and 10, a seal (24) is coupled with dispenser (22) to seal each conduit (43) with a single piece. As such, seal (24) comprises a tab that extends over both recesses (33) of dispenser (22). In the illustrated embodiment, seal (24) is shown as an oval, but other suitable shapes may be used (e.g., circle, rectangle, square, etc.). Seal (24) is coupled to dispenser (22) at each recess (33) via a neck portion (37). Each neck portion (37) comprises an opening (31) that extends through neck portion (37) and ends at the tab portion of seal (24). Accordingly, seal (24) can be twisted relative to dispenser (22) to break seal (24) from dispenser (22) at each neck portion (31). This reveals each opening (31), which is in fluid communication with recesses (33) and conduits (43) to thereby allow the products within each tube (42, 44) to be dispensed separately through openings (31). Once seal (24) is removed, the entire contents of tubes (42, 44) can be used. Applicator (20) can be injection molded as a single piece from polypropylene, high-density polyethylene resin, or any other suitable material. In some embodiments, dispenser (22) is optional such that seal (24) can be directly coupled with conduits (43) to seal tubes (42, 44).

Figure 11A:
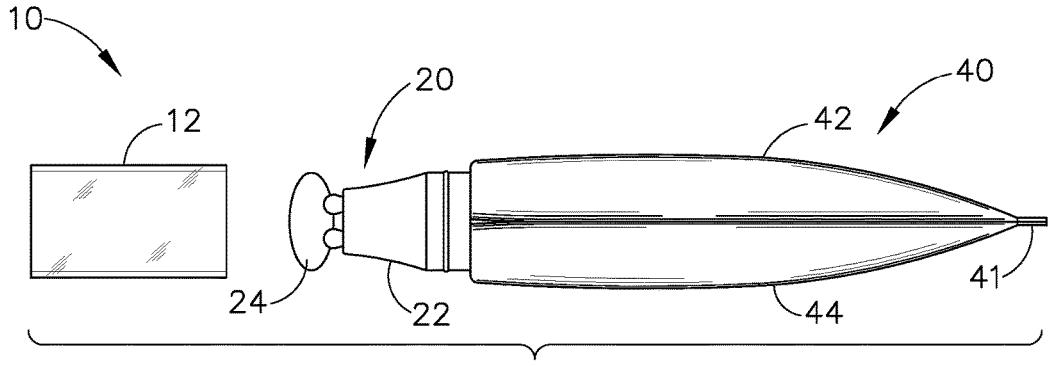
FIG. 11A depicts a side view of the product package of FIG. 1 with the cap removed.
Figure 11B:
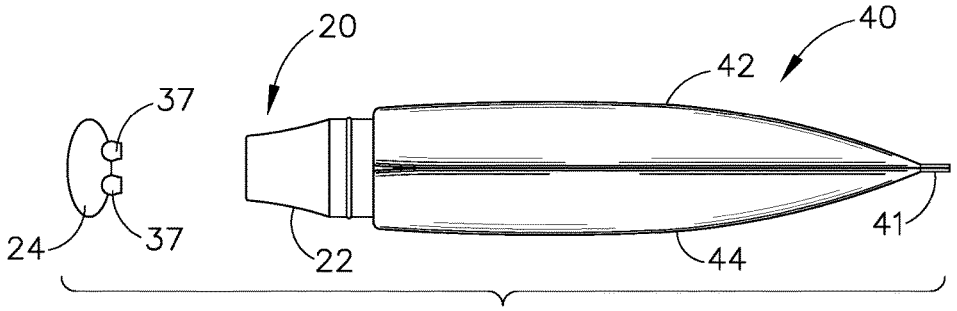
FIG. 11B depicts a side view of the product package of FIG. 11A with the seal removed.
Figure 11C:
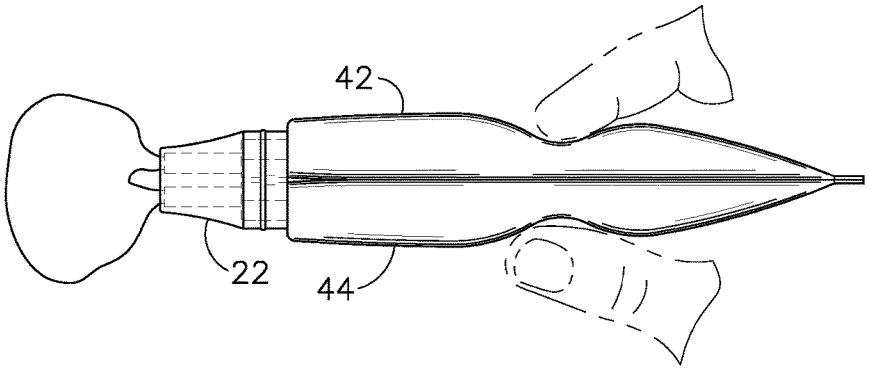
FIG. 11C depicts a side view of the product package of FIG. 11A being squeezed to dispense a product from the product package.

A method for operating product package (10) is shown in FIGS. 11A-11C. For instance, FIG. 11A shows cap (12) removed from applicator (20). A user can then grasp the single seal (24) of applicator (20) and rotate the seal (24) relative to applicator (20). This breaks seal (24) from dispenser (22) of applicator (20) at neck portions (37) of applicator (20), as shown in FIG. 11B. Accordingly, each conduit (43) of tubes (42, 44) are revealed by easily removing a single seal (24). A user can then squeeze tubes (42, 44), as shown in FIG. 11C. By squeezing tubes (42, 44), the product stored in each tube (42, 44) is dispensed through opening (49) in each conduit (43), through a recess (33), and through an opening (31) in applicator (20). Each product in tubes (42, 44) is thereby dispensed separately from applicator (20), where the products can then be mixed together for use.

It should be understood that any one or more of the teachings, expressions, embodiments, examples, etc. disclosed herein may be combined with any one or more of the other teachings, expressions, embodiments, examples, etc. that are disclosed herein. The teachings, expressions, embodiments, examples, etc. disclosed herein should therefore not be viewed in isolation relative to each other. Various suitable ways in which numerous aspects of the present disclosure may be combined will be readily apparent to those of ordinary skill in the art in view of the teachings disclosed herein. Such modifications and variations are intended to be included within the scope of both the present disclosure and the claims.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, examples, embodiments, geometrics, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

What is claimed is:

1. A package for dispensing product comprising:

a tube assembly, wherein the tube assembly comprises:

a plurality of tubes, wherein each tube of the plurality of tubes is configured to hold a product, and a plurality of tube head assemblies, wherein each tube head assembly of the plurality of tube head assemblies is coupled with a corresponding tube of the plurality of tubes, wherein each tube head assembly of the plurality of tube head assemblies comprises a conduit in fluid communication with the product held in the corresponding tube; and an applicator coupled with the tube assembly, wherein the applicator comprises one seal configured to seal a plurality of conduits of the tube assembly;

wherein the applicator further comprises a dispenser, wherein the dispenser comprises a plurality of openings, wherein each opening of the plurality of openings is configured to receive a corresponding conduit of the plurality of tube head assemblies such that each opening of the plurality of openings is in fluid communication with the corresponding conduit, wherein the seal is configured to seal each opening of the plurality of openings; each tube head assembly of the plurality of tube head assemblies further comprises a neck positioned between the corresponding conduit and tube, wherein the dispenser is configured to receive the neck;

wherein the dispenser comprises a neck portion extending from each opening of the plurality of openings, wherein the neck portion is attached to the seal;

wherein the seal is twistable and breakable relative to the dispenser such that the seal is configured to detach from the neck portion when the seal is rotated relative to the dispenser.

2. The package of claim 1, wherein each opening of the plurality of openings comprises a throttling orifice.

3. The package of claim 1, wherein the dispenser comprises a protrusion extending inwardly within the dispenser, wherein the protrusion is configured to abut a flat surface of the neck.

4. The package of claim 1, wherein the seal is configured to open the conduit of each of the tube head assembly when the seal is rotated relative to the tube assembly.

5. The package of claim 4, wherein the package is configured to dispense the product from each tube of the plurality of tubes through the corresponding conduit.

6. The package of claim 1, wherein each tube of the plurality of tubes is flexible.

7. The package of claim 1, further comprising a cap removably coupled with the tube assembly.

8. The package of claim 1, wherein the tube assembly comprises:

a first tube comprising an open end and a closed end, wherein the first tube is configured to hold a first product, a first tube head assembly coupled with the open end of the first tube, wherein the first tube head assembly comprises a first conduit in fluid communication with the first product, a second tube comprising an open end and a closed end, wherein the second tube is configured to hold a second product, and a second tube head assembly coupled with the open end of the second tube, wherein the second tube head assembly comprises a second conduit in fluid communication with the second product.

9. The package of claim 8, wherein the dispenser comprising a first recess to receive the first conduit and a second recess to receive the second conduit.

10. The package of claim 8, wherein the closed ends of the first tube and the second tube are coupled together.

11. The package of claim 8, wherein the first tube and the second tube comprise a substantially circular profile when the first tube is positioned adjacent to the second tube.

12. The package of claim 8, wherein the first tube head assembly comprises a first neck coupling the first conduit with the open end of the first tube, wherein the second tube head assembly comprises a second neck coupling the second conduit with the open end of the second tube.

13. The package of claim 12, wherein the first neck comprises a first slot, wherein the second neck comprises a second slot, wherein the first and second slots are configured to receive a connector to maintain the position of the first neck relative to the second neck.

14. The package of claim 8, wherein the applicator is injection molded as a single piece.

15. The package of claim 8, wherein the first tube head assembly is injection molded onto the open end of the first tube, wherein the second tube head assembly is injection molded onto the open end of the second tube.

* * * * *